US006827627B2

(12) United States Patent
Tsang

(10) Patent No.: US 6,827,627 B2
(45) Date of Patent: Dec. 7, 2004

(54) MAGNETIC STEERING ASSEMBLY FOR A TOY VEHICLE

(75) Inventor: Sek Wan Tsang, Room 707, Tien Cheung Hong Building 77-81 Jervois Street, Hong Kong (CN)

(73) Assignee: Sek Wan Tsang, Hong Kong (CN)

( * ) Notice: Subject to any disclaimer, the term of this patent is extended or adjusted under 35 U.S.C. 154(b) by 0 days.

(21) Appl. No.: 10/047,473

(22) Filed: Oct. 23, 2001

(65) Prior Publication Data

US 2002/0123296 A1 Sep. 5, 2002

Related U.S. Application Data

(63) Continuation-in-part of application No. 09/457,256, filed on Dec. 8, 1999, now Pat. No. 6,350,173.

(51) Int. Cl.[7] ..... A63H 17/00
(52) U.S. Cl. ..... 446/434; 446/457
(58) Field of Search ..... 446/431, 434, 446/448, 449, 454, 457, 460, 465, 468

(56) References Cited

U.S. PATENT DOCUMENTS

| | | | | |
|---|---|---|---|---|
| 3,579,906 A | | 5/1971 | La Forge | |
| 3,594,951 A | * | 7/1971 | Perhacs, Jr. | 446/434 |
| 3,775,902 A | * | 12/1973 | Gagnon | 446/434 |
| 4,163,341 A | | 8/1979 | Jones et al. | |
| 4,471,566 A | | 9/1984 | Ishimoto | |
| 4,563,162 A | | 1/1986 | Ishimoto | |
| 4,571,213 A | | 2/1986 | Ishimoto | |
| 4,698,044 A | * | 10/1987 | Kennedy et al. | 446/434 |
| 4,816,795 A | | 3/1989 | Suto | |
| 4,854,909 A | | 8/1989 | Ishimoto | |
| 4,889,515 A | * | 12/1989 | Auer et al. | 446/428 |
| 4,898,562 A | | 2/1990 | Ishimoto | |
| 5,372,534 A | * | 12/1994 | Levy et al. | 446/457 |
| 5,626,506 A | * | 5/1997 | Halford et al. | 446/465 |

FOREIGN PATENT DOCUMENTS

JP 4-135591 A 5/1992

* cited by examiner

*Primary Examiner*—Kurt Fernstrom
(74) *Attorney, Agent, or Firm*—Merchant & Gould P.C.

(57) ABSTRACT

The invention relates to a toy vehicle having steerable wheels, to a steering mechanism for such a vehicle, and to a steering module incorporated in the steering mechanism. The steering module includes a coil having a first end and a second end with a central axis extending between the first and second ends thereof, a bar disposed adjacent the first end of the coil and mounted along a substantially linear axis generally perpendicular to the central axis of the coil. The coil and the bar are mounted to be moveable relative to each other. The bar includes first and second magnets mounted on the bar along the substantially linear axis. The first and second magnets each include a north pole and a south pole, with the north pole of the first magnet facing the first end of the coil and the south pole of the second magnet facing the first end of the coil. The steering mechanism is compact in size with few parts. Further, the steering module is adaptable for use with toy cars of very small size, and the module can be installed at a variety of positions on the toy vehicle.

3 Claims, 13 Drawing Sheets

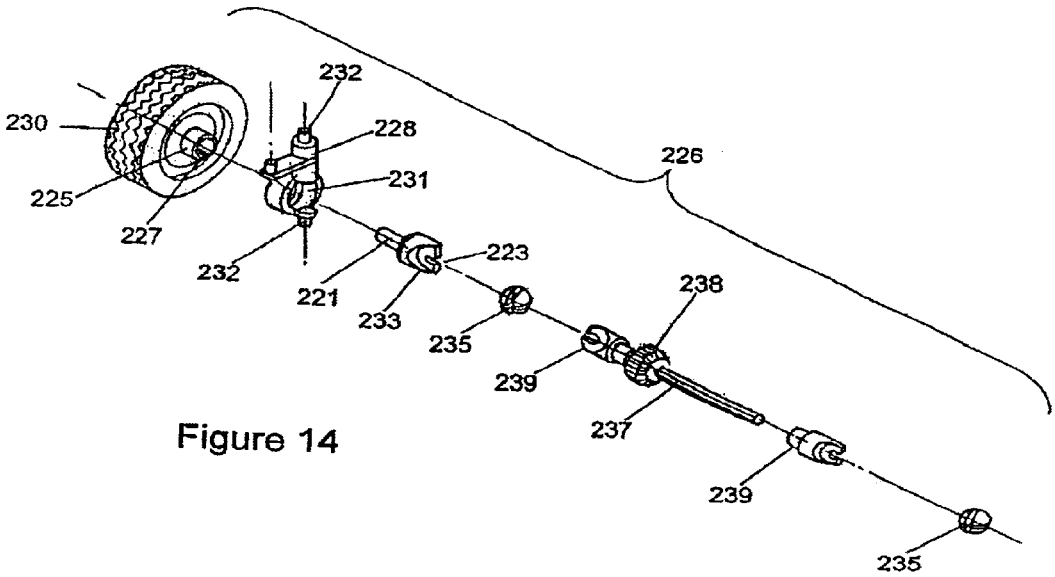
Figure 14
Figure 13
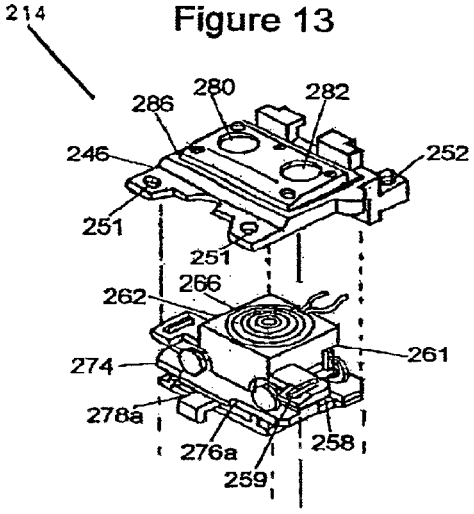
Figure 15
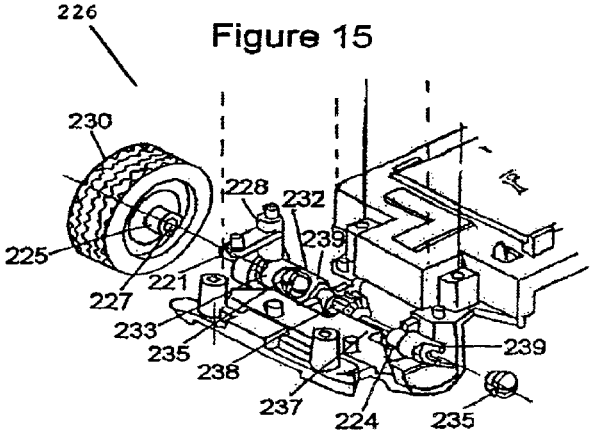

MAGNETIC STEERING ASSEMBLY FOR A TOY VEHICLE

This application is a continuation-in-part of application Ser. No. 09/457,256 filed on Dec. 8, 1999, now U.S. Pat. No. 6,350,173.

FIELD

The invention relates generally to toy vehicles, and more particularly to toy vehicles having steerable wheels in order to enable control of the direction of travel of the toy vehicle. The invention has potential application on numerous types of toy vehicles, including toy cars, toy trains, toy trucks and the like. The invention is preferably used on toy vehicles that are radio-controlled, although the invention can be used on any toy vehicle having wheels that can be steered on command by an operator of the vehicle.

BACKGROUND

In the toy vehicle art, there is a need to keep the toy vehicle relatively simple in design with fewer parts, as well as to reduce the size and weight of the toy vehicle and to reduce costs. This is particularly important in toy vehicles having steerable wheels, since the steering mechanism for steering the wheels must be incorporated onto the toy vehicle. Any steering mechanism design that is able to reduce parts and simplify design, as well as reduce vehicle size, weight and costs, would be beneficial.

Numerous toy vehicle steering mechanisms for steering toy vehicles are known from the prior art, as illustrated by U.S. Pat. Nos. 4,163,341; 4,571,213; 4,471,566; 4,898,562; 4,854,909; 4,563,162; 4,816,795; 3,579,906; and JP 4-135591. While these known mechanisms are generally satisfactory for their intended purpose, there is a continuing need for an improved steering mechanism that saves space, thereby reducing vehicle size, and that saves costs, both in the steering mechanism itself and in the toy vehicle in which the steering mechanism is used.

SUMMARY

An improved steering mechanism for a toy vehicle is provided, particularly a toy vehicle having wheels that are steerable by an operator of the toy vehicle through suitable commands input by the operator. The steering mechanism uses a minimum number of parts and simple, relatively cheap materials. The steering mechanism has a relatively small size, thereby reducing the size of the vehicle, and can be installed at a variety of locations and positions on the vehicle. Further, the design of the steering mechanism improves the steering action on the wheels. Moreover, the small size and improved steering action permits the steering mechanism to be incorporated into very small toy vehicles.

As defined by the claims appended hereto, in one embodiment in accordance with the principles of the invention, a toy vehicle is provided that includes a chassis, first and second wheels pivotally mounted to the chassis, and a steering mechanism mounted on the chassis and operatively connected to the first and second wheels for steering the wheels. The steering mechanism includes a steering module having a coil disposed on the chassis, with the coil having a first end and a second end with a central axis extending between the first and second ends thereof. The coil may be operatively connected with a first bar. The first bar may be disposed adjacent the first end of the coil and mounted along a first substantially linear axis generally perpendicular to the central axis of the coil. The coil and the first bar are mounted to be moveable relative to one another. In addition, first and second magnets are mounted on the first bar along the first substantially linear axis. The first and second magnets each include a north pole and a south pole, with the north pole of the first magnet facing the first end of the coil and the south pole of the second magnet facing the first end of the coil. The steering module may include a biasing mechanism to bias the steering module to a normally central position when a current flow through the coil is stopped.

In another embodiment in accordance with the principles of the invention, a steering mechanism is provided for a toy vehicle having first and second wheels. The steering mechanism comprises a steering module including a coil having a first end and a second end with a central axis extending between the first and second ends thereof. The steering module further includes a first bar disposed adjacent a first end of a coil. The coil may be stationary while the first bar is slidably engaged with the coil, and mounted for movement along a first substantially linear axis generally perpendicular to the central axis of the coil. The first bar has a first end operatively connected to the first wheel and a second end operatively connected to the second wheel whereby movement of the first bar along the first substantially linear axis results in pivoting movement of the first and second wheels. In addition, first and second magnets are mounted on the first bar and are moveable therewith along the first substantially linear axis. The first and second magnets each include a north pole and a south pole, with the north pole of the first magnet facing the first end of the coil and the south pole of the second magnet facing the first end of the coil.

In yet another embodiment in accordance with the principles of the invention, a steering mechanism is provided for a toy vehicle having first and second wheels. The steering mechanism comprises a steering module including a coil having a first end and a second end with a central axis extending between the first and second ends thereof. The steering module includes a first bar disposed adjacent a first end of a coil, and extended along a first substantially linear axis generally perpendicular to a central axis of the coil. The first bar may be stationary while the coil may be slidably engaged with the first bar along the first linear axis. The coil may be disposed within a frame, and the frame has a first side operatively connected to the first wheel and a second side operatively connected to the second wheel whereby movement of the coil along the first linear axis results in pivoting movement of the first and second wheels. In addition, first and second magnets are mounted on the first bar. The first and second magnets each include a north pole and a south pole, with the north pole of the first magnet facing the first end of the coil and the south pole of the second magnet facing the first end of the coil.

In another embodiment in accordance with the principles of the invention, a steering module for a toy vehicle is provided. The steering module includes a coil having a first end and a second end with a central axis extending between the first and second ends thereof, a bar disposed adjacent the first end of the coil and mounted for movement along a substantially linear axis generally perpendicular to the central axis of the coil, and first and second magnets mounted on the bar and moveable therewith along the substantially linear axis. The first and second magnets each include a north pole and a south pole, with the north pole of the first magnet facing the first end of the coil and the south pole of the second magnet facing the first end of the coil.

In yet another embodiment in accordance with the principles of the invention, a steering module for a toy vehicle is provided. The steering module includes a coil having a first end and a second end with a central axis extending between the first and second ends thereof, a bar disposed adjacent the first end of the coil and mounted along a first substantially linear axis generally perpendicular to the central axis of the coil. The coil may be disposed within a frame, and may be slidably engaged with the bar along the first substantially linear axis. First and second magnets are mounted on the bar and along the first substantially linear axis of the bar. The first and second magnets each include a north pole and a south pole, with the north pole of the first magnet facing the first end of the coil and the south pole of the second magnet facing the first end of the coil.

In another embodiment in accordance with the principles of the present invention, a wheel assembly for a toy vehicle includes a bar member including a first end and a second end, a spindle portion connected at each of the first and second ends of the bar member. The spindle portions each include a through hole, and the spindle portions enable steering of the toy vehicle. Further, the wheel assembly includes first and second wheels each having a boss that has a hole, the first wheel being operatively connected to the first end of the bar member and the second wheel being operatively connected to the second end of the bar member.

In another embodiment in accordance with the principles of the present invention, a toy vehicle is provided that includes a chassis, first and second wheels pivotally mounted to the chassis, and a steering mechanism mounted on the chassis and operatively connected to the first and second wheels for steering the wheels. The toy vehicle also includes a trailer portion. The trailer portion may have a gear assembly for turning the trailer portion.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

FIG. 13 illustrates a partially exploded perspective view of the steering module of FIG. 12.

FIG. 14 illustrates an exploded view of an embodiment of a wheel assembly in accordance with the principles of the present invention.

FIG. 15 illustrates the wheel assembly of FIG. 14 as incorporated with a toy vehicle.

DETAILED DESCRIPTION

The invention relates to a toy vehicle having steerable wheels, to a steering mechanism for such a vehicle, and to a steering module incorporated in the steering mechanism. The design of the steering module is simple with few parts, thereby permitting a reduction in the size and weight of the steering mechanism and of the toy vehicle itself. Further, the steering module is adaptable for use with toy cars of very small size, and the module can be installed at a variety of positions on the toy vehicle.

With reference now to the figures, one implementation of a toy vehicle 10 utilizing a steering mechanism 12 with a steering module 14 of the invention is illustrated. Only the front end of the toy vehicle 10 is illustrated in the figures, it being understood that the rear end of the vehicle includes an additional set of wheels. The toy vehicle 10 is preferably of the type whose rear wheels are driven by an electric motor (not shown) suitably positioned on the vehicle. Power for running the motor is provided by a power source 16, such as one or more batteries, positioned on the vehicle. The vehicle is preferably operated by a suitable wireless control system of a type generally known in the art.

Figure 1:
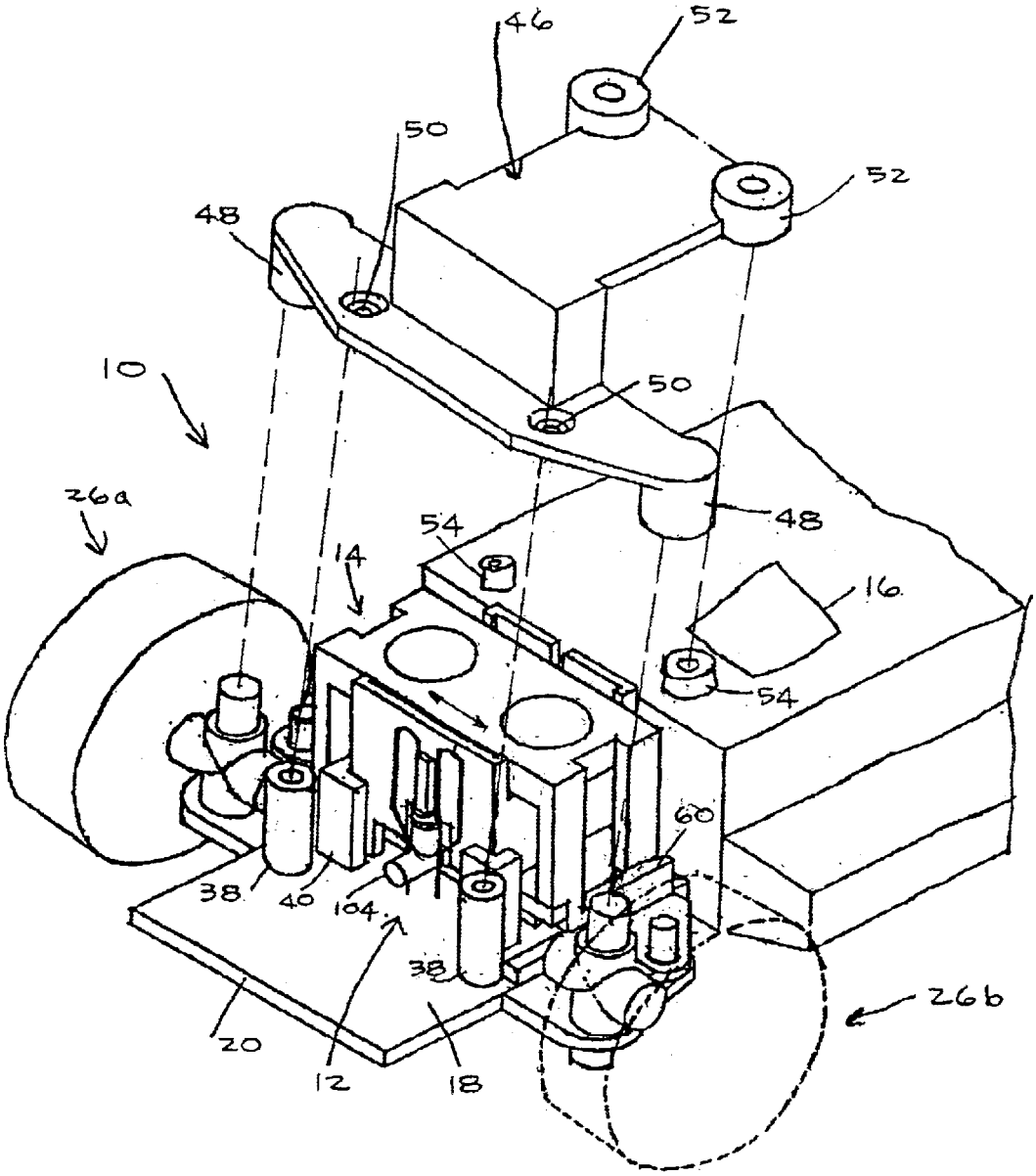
FIG. 1 is a perspective view of the front end of a toy vehicle incorporating the steering mechanism of the invention.
Figure 4:
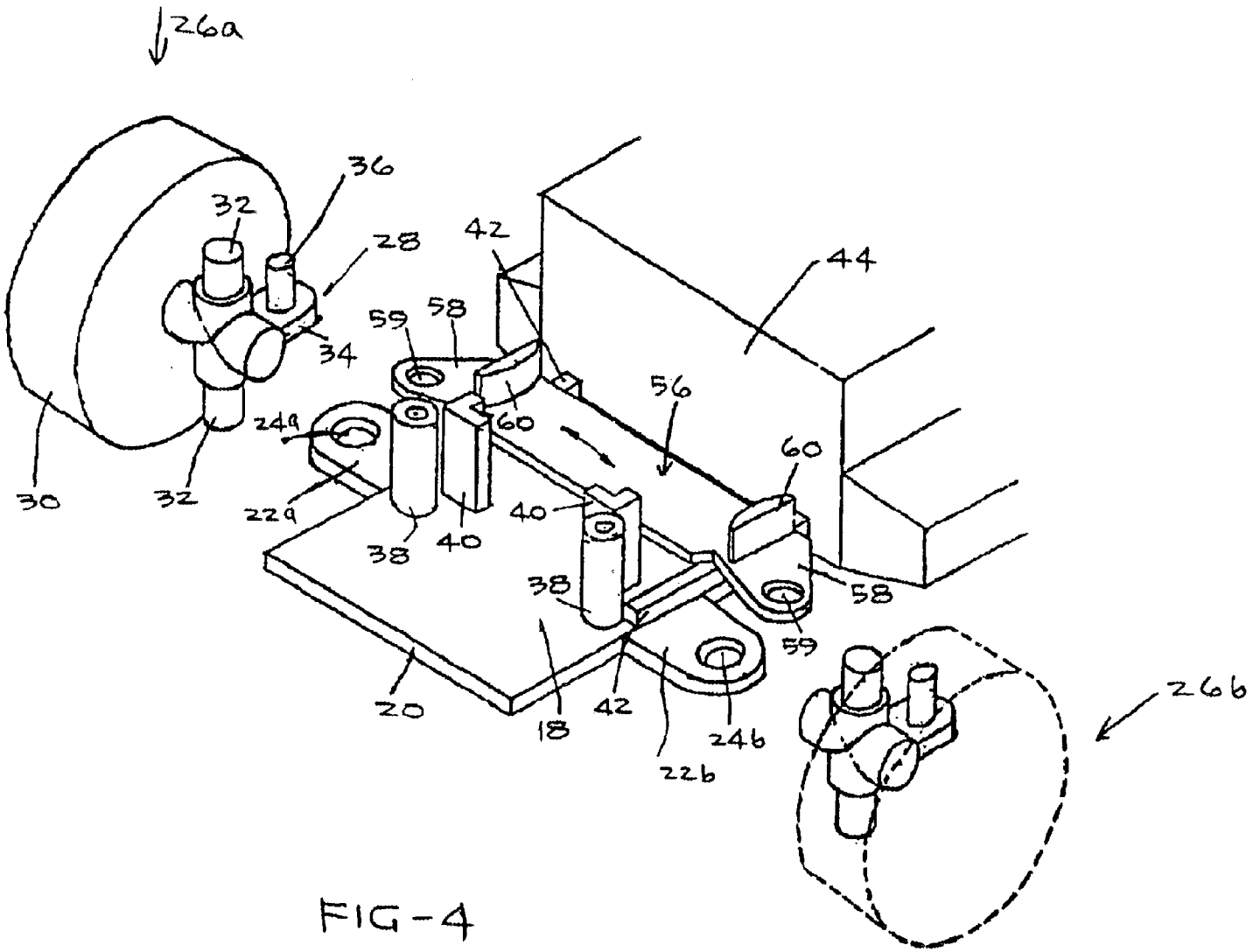
FIG. 4 depicts other elements of the steering mechanism.

Referring now to FIGS. 1 and 4, the toy vehicle 10 includes a chassis 18 with a front end 20. Projecting from each side of the chassis 18 are tabs 22*a*, 22*b* each formed with respective holes 24*a*, 24*b* therein. Right and left wheel assemblies 26*a*, 26*b* are mounted to the tabs 22*a*, 22*b* to permit pivoting movement of each wheel assembly. The wheel assemblies 26*a*, 26*b* are identical and therefore only the wheel assembly 26*a* will be described in detail.

The wheel assembly 26*a* includes a spindle 28 and a wheel 30 that is rotatably mounted on the spindle 28. The spindle 28 includes pins 32 extending from the top and bottom thereof, with the bottom pin 32 being rotatably disposed within the hole 24*a* to enable the spindle 28, and thus the wheel assembly, to pivot about a generally vertical axis. Extending rearwardly from the spindle 28 is an arm 34 with a vertical pin 36 adjacent the end thereof, the purpose of which will be described below.

Extending upwardly from the chassis 18 is a pair of support posts 38 each having a threaded hole, and a pair of right angle members 40. Further, a pair of rails 42 is disposed on the top surface of the chassis 18 at the sides thereof, and extend forwardly from a central portion 44 of the vehicle 10 to adjacent the support posts 38. As shown in FIG. 1, a cover 46 is provided in order to retain the wheels assemblies 26*a*, 26*b*, the steering mechanism 12 and the steering module 14 in place on the chassis 18. The cover 46 includes a pair of caps 48 that are designed to fit over, and rotatably support, the top pins 32 on the spindles 28. The cover 46 also has a pair of apertures 50 that align with the threaded holes in the support posts 38 whereby the cover 46 can be fastened to the chassis 18 using screws. A pair of bosses 52 is provided at the rear end of the cover 46 that cooperate with corresponding bosses 54 provided on the central portion 44 of the vehicle to permit attachment of the rear end of the cover.

As shown in FIG. 4, an actuating bar 56 is positioned on top of the rails 42 between the right angle member 40 and the central portion 44. The actuating bar 56, together with the steering module 14 to be later described, form the steering mechanism 12 of the invention. As indicated by the arrows in FIG. 4, the actuating bar 56 is slidably disposed on the chassis 18 for sliding movement to the left and to the right along a generally linear axis. The actuating bar 56 includes tabs 58 that project from the sides of the chassis 18, with each tab 58 including a hole 59 therein to receive the respective pin 36 on the spindle arm 34, as best seen in FIG. 1. Thus, as the actuating bar 56 moves to the right and the left, the movement is transmitted through the spindle arms 34 to the spindle 28 thereby causing the wheels 30 to steer to the right and the left.

Returning to FIG. 1, it is the steering module 14 that causes the actuating bar 56 to move to the right and left. The steering module 14 is positioned between a pair of tabs 60 projecting upward from the actuating bar 56 whereby movement of a portion of the steering module 14 to the right and to the left, shown by the arrows in FIG. 1, is transmitted to the actuating bar 56. As mentioned above, the steering module 14 and the actuating bar 56 form the steering mechanism 12 of the toy vehicle.

Figure 2:
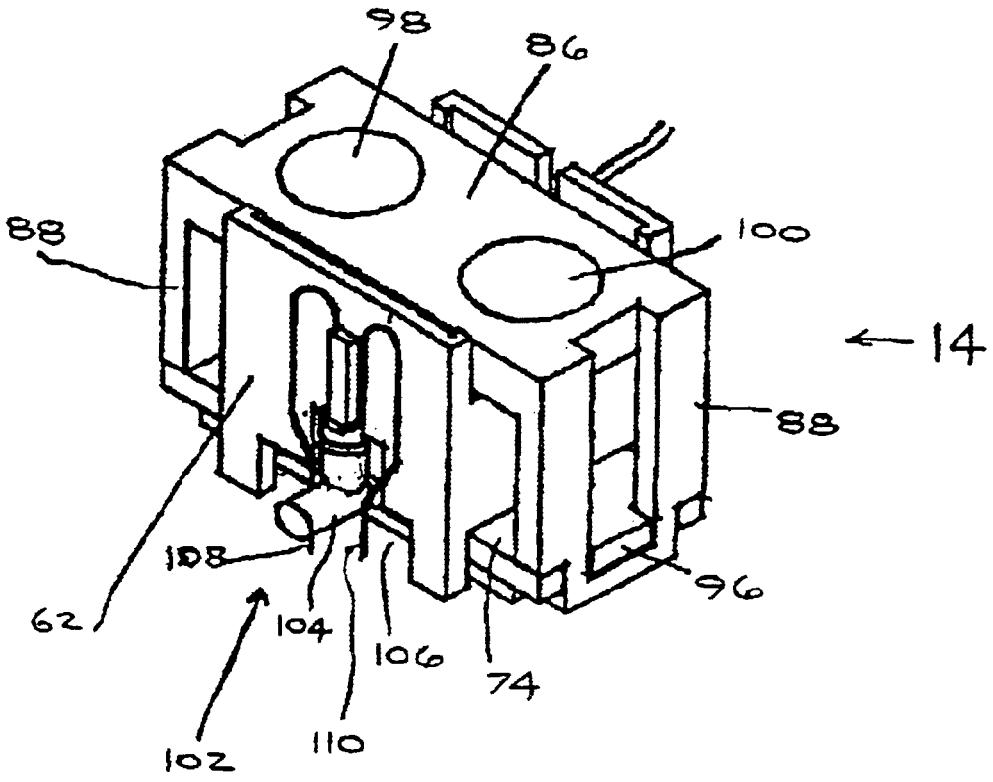
FIG. 2 is a perspective view of the steering module utilized in the steering mechanism.
Figure 3:
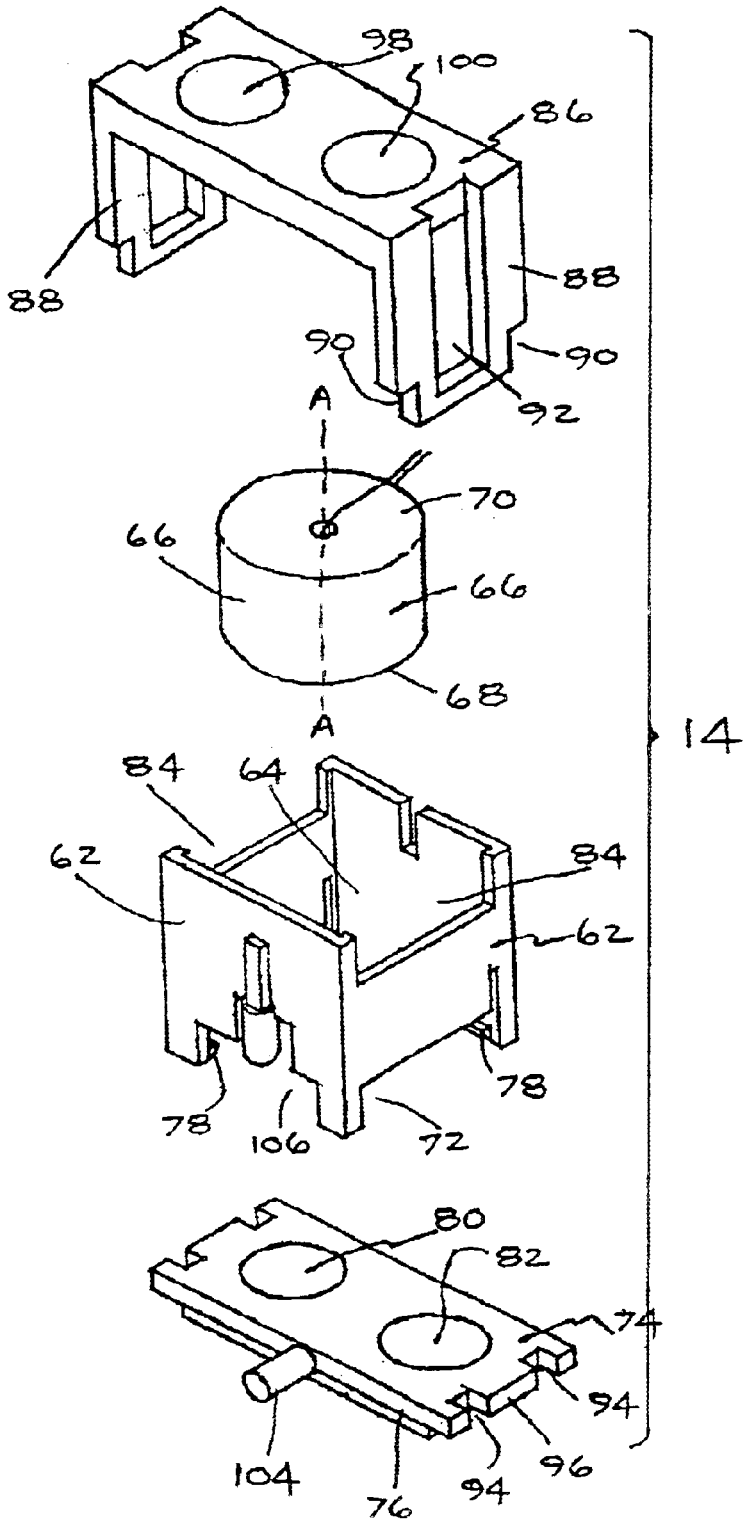
FIG. 3 is an exploded view illustrating components of the steering module.

FIGS. 2 and 3 illustrate the steering module 14 in detail. The module 14 includes a generally rectangular frame 62, which as shown in FIG. 1, cooperates with the right angle members 40 and the central portion 44 whereby the frame 62 is fixed on the chassis 18. The frame 62 is preferably made from plastic in order to reduce vehicle weight and costs. The frame 62 includes a generally hollow central area 64 that receives therein a coil 66. The coil 66 has a first end 68 and a second end 70 with an axis A—A extending between the ends 68, 70 through the center of the coil. The coil 66 is sized to fit snugly within the hollow area 64 to thereby retain the coil within the frame 62.

The bottom of the frame 62 includes a cut-out section 72 in opposite side walls thereof in order to receive a first slide bar 74. The slide bar 74, which is preferably made from plastic to reduce weight and costs, includes rails 76 cut on each side thereof that cooperate with rails 78 formed on opposite walls of the frame 62, whereby the slide bar 74 is slidable to the right and left relative to the frame. Mounted on the slide bar 74, at spaced locations thereon, is a pair of magnetic disks 80, 82.

The top of the frame 62 also includes a cut-out section 84 in opposite side walls thereof that receive a second slide bar 86. The second slide bar 86, like the first slide bar 74, is preferably made from plastic to weight and costs. Extending downward from opposite ends of the slide bar 86 are connecting arms 88, each of which is provided with notches 90 at the ends thereof and a central slot 92. The ends of the first slide bar 74 are provided with a pair of spaced notches 94 between which is a tab 96. As shown in FIG. 2, the ends of the connecting arms 88 are designed to engage with the ends of the first slide bar 74, with the tab 96 fitting into the slot 92 and the notches 90, 94 cooperating with each other, whereby the first and second slide bars 74, 86 are connected together so as to move in unison to the right and the left.

Further, like the first slide bar 74, the second slide bar 86 is also provided with a pair of magnetic disks 98, 100 mounted at spaced locations thereon. The slide bars 74, 86 and magnetic disks 80, 82, 98, 100 are positioned such that the disk 80 is generally vertically aligned with the disk 98, and the disk 82 is generally vertically aligned with the disk 100. Although the magnets 80, 82, 98, 100 have been described as being discs, it is to be realized that other shapes could be used for the magnets as well.

Figure 5:
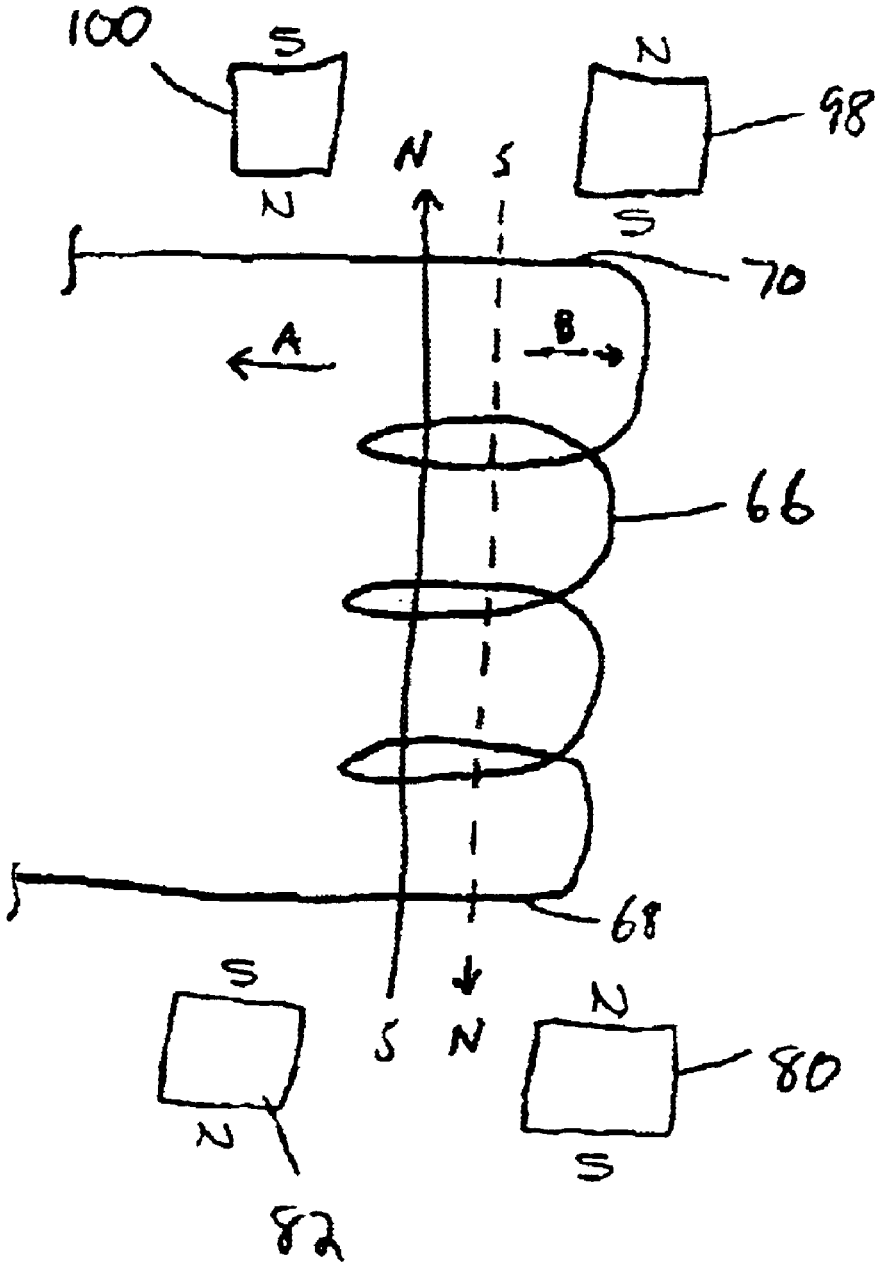
FIG. 5 is a schematic illustration depicting the interaction of the coil and the magnets of the steering module.

As shown in FIG. 5, each of the magnets 80, 82, 98, 100 includes a north pole and a south pole. For the slide bar 74, the magnets 80, 82 are arranged such that the north pole of the magnet 80 faces the end 68 of the coil 66 while the south pole of the magnet 82 faces the end 68. Likewise, for the slide bar 86, the magnets 98, 100 are arranged such that the south pole of the magnet 98 faces the end 70 of the coil 66, while the north pole of the magnet 100 faces the end 70.

By controlling the direction of current through the coil 66, thereby controlling its polarity, the slide bars 74, 86 can be forced to the right or to the left due to attraction and repulsion of the respective magnets. For instance, as shown in FIG. 5, when current is directed through the coil 66 such that the N-polarity points upward, the magnets 80, 98 are attracted in the direction of arrow A while the magnets 82, 100 are repulsed in the direction of arrow A, thereby causing the slide bars 74, 86 to shift resulting in a steering action on the wheels. When the current is reversed such that the N-polarity points downward, the magnets 80, 98 are repulsed in the direction of dashed arrow B while the magnets 82, 100 are attracted in the direction of dashed arrow B, thereby causing the slide bars 74, 86 to shift resulting in a steering action on the wheels. Circuitry for controlling the direction of current flow through the coil 66 is known in the art and need not be described herein. The electricity for the current flow is provided by the power source 16.

A biasing mechanism 102 is also provided in order to bias the slide bars 74, 86 to a central position once current flow through the coil 66 is stopped. As shown in FIGS. 2 and 3, a pin 104 projects from the slide bar 74 through a cut-out 106 provided in the frame 62. A pair of spring arms 108, 110 is disposed on either side of the pin 104 for biasing the slide bar 74 back to its central position after sliding either left or right. The spring arms 108, 110 preferably form the opposite ends of the same single piece of flexible wire that is suitably fixed to the frame 62. However, the spring arms could be from separate wire elements that are each fixed to the frame.

Figure 6:
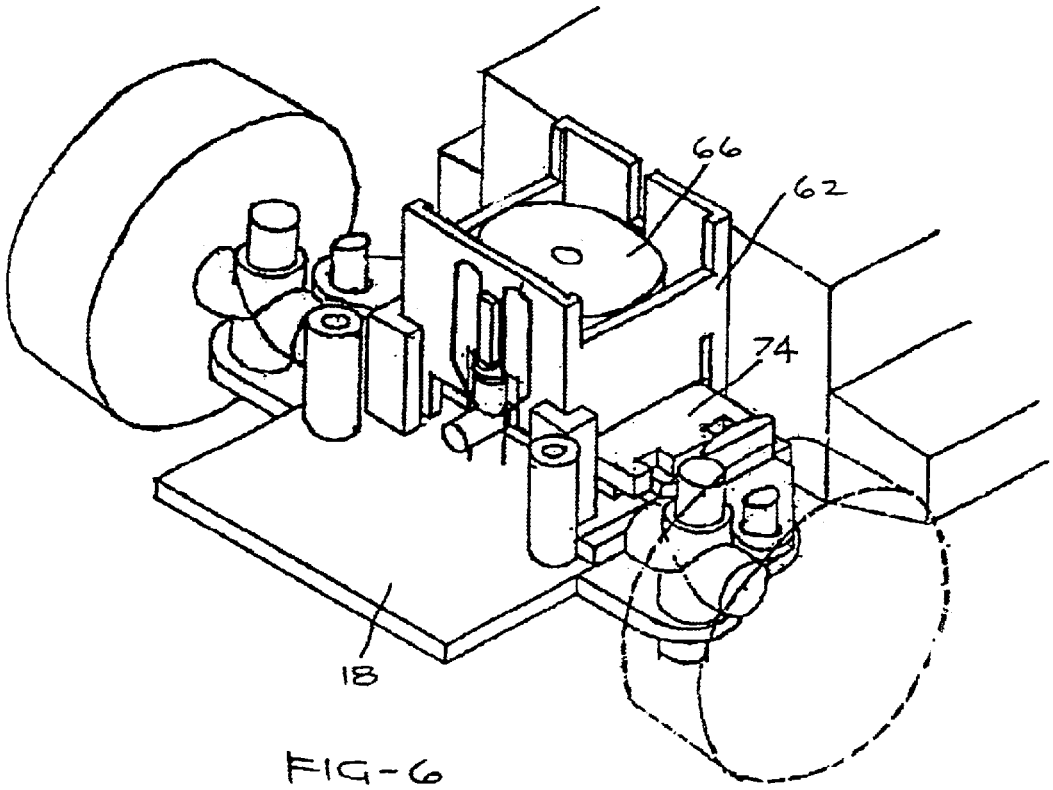
FIG. 6 is a perspective view of the front end of a toy vehicle incorporating an alternative embodiment of a steering mechanism.
Figure 7:
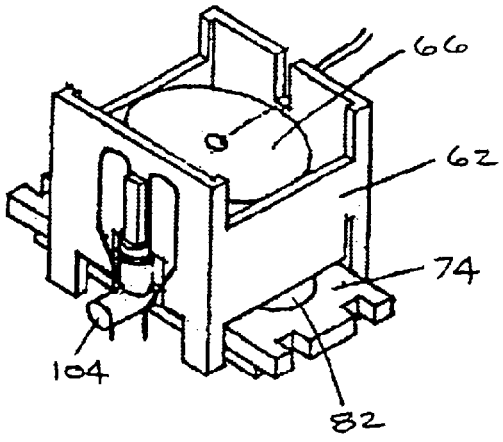
FIG. 7 is a perspective view of the steering module utilized in the steering mechanism of FIG. 6.

The embodiment described thus far and shown in FIGS. 1–5 has utilized a pair of slide bars 74, 86. The use of two slide bars and their corresponding magnets provides the maximum amount of steering force. However, when a smaller steering force will suffice, it is possible to utilize the steering module 14 with only a single slide bar. Referring to FIGS. 6 and 7, it is seen that the second slide bar 86 of the steering module 14 has been removed, and only the first slide bar 74 is present. This embodiment permits use of the steering module on smaller toy vehicles and those toy vehicles that require a smaller amount of steering force.

Figure 8:
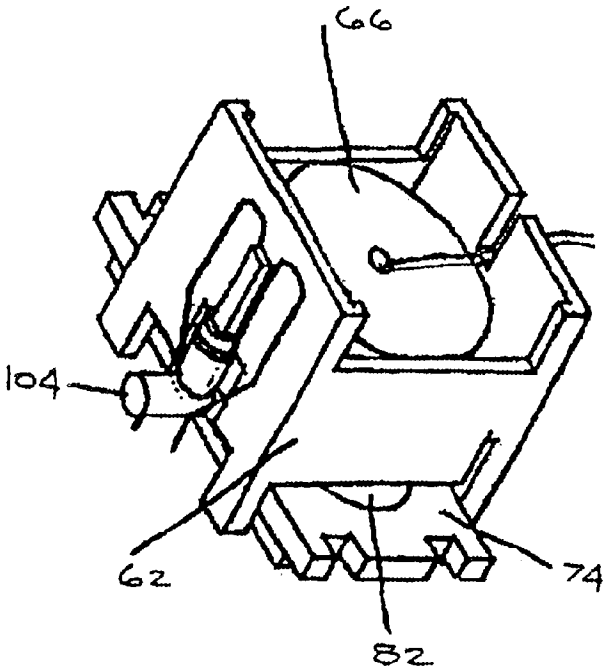
FIG. 8 illustrates an alternative orientation of the steering module.

In addition, the invention thus far described has had the core 66 of the steering module 14 oriented such that the axis A—A thereof extends generally vertically relative to the vehicle. However, it is to be realized that the steering module 14 could be oriented in such a manner that the axis A—A of the core 66 extends generally forward and aft of the toy vehicle. Such an orientation is illustrated in FIG. 8. The actuating bar 56 would have to be suitably modified in order to actuated by the slide bar. The embodiment illustrated in FIG. 8 could also be used with the second slide bar as well.

Figure 9:
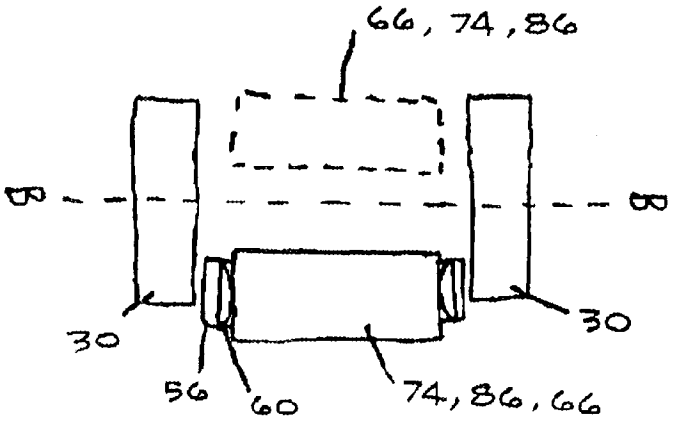
FIG. 9 illustrates the position of the steering module relative to a rotation axis of the wheels.

One of the advantages provided by the steering module 14 and steering mechanism 12 described herein is that they are compact and take up very little space on the vehicle. Therefore, the vehicle size can be reduced. To illustrate the compact nature of the invention, reference should be made to FIG. 9, which show the front wheels 30, each of which is rotatable about a respective rotation axis forming a common axis B—B. As FIG. 9 schematically illustrates, the actuating bar 56 and the slide bars 74, 86 and the coil 66 of the steering module 14, are positioned entirely to the rear of the axis B—B. Likewise, in keeping with the flexible nature of the invention, FIG. 9 illustrates in dashed lines that the actuating bar, slide bars and coil can be positioned entirely in front of the axis B—B. Thus, the steering mechanism 12 takes up very little fore and aft space, and it can be positioned at different locations depending upon the space that is available on the toy vehicle.

Figure 10:
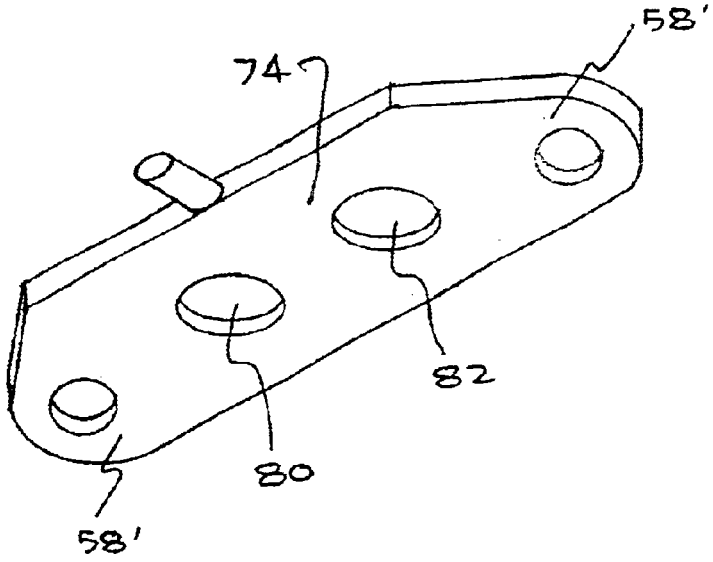
FIG. 10 illustrates a variation in which the actuating bar and the first slide bar are combined into a single, one-piece unit.

FIG. 10 illustrates a variation in which the actuating bar 56 and the first slide bar 74 are combined into an integral, one-piece unit, in which the slide bar 74 is provided with tabs 58 at both ends. Thus, in this version, the steering mechanism is comprised of only the steering module itself, as the actuating bar has essentially been eliminated. This design further reduces size, weight and costs of the toy vehicle.

Figure 11:
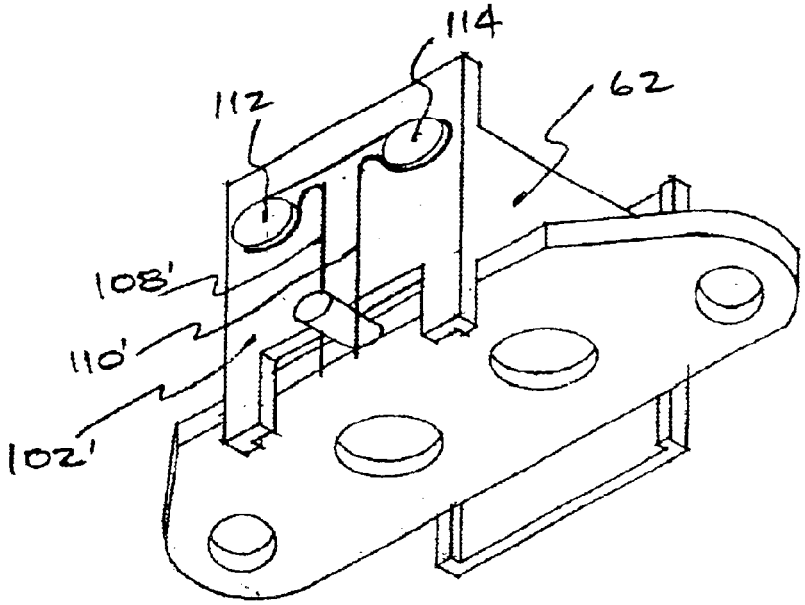
FIG. 11 illustrates a variation of the biasing mechanism.

FIG. 11 illustrates a variation utilizing a biasing mechanism 102' in which the spring arms 108', 110' are separate wire elements fixed to respective mounting elements 112, 114 on the frame 62.

Figure 12:
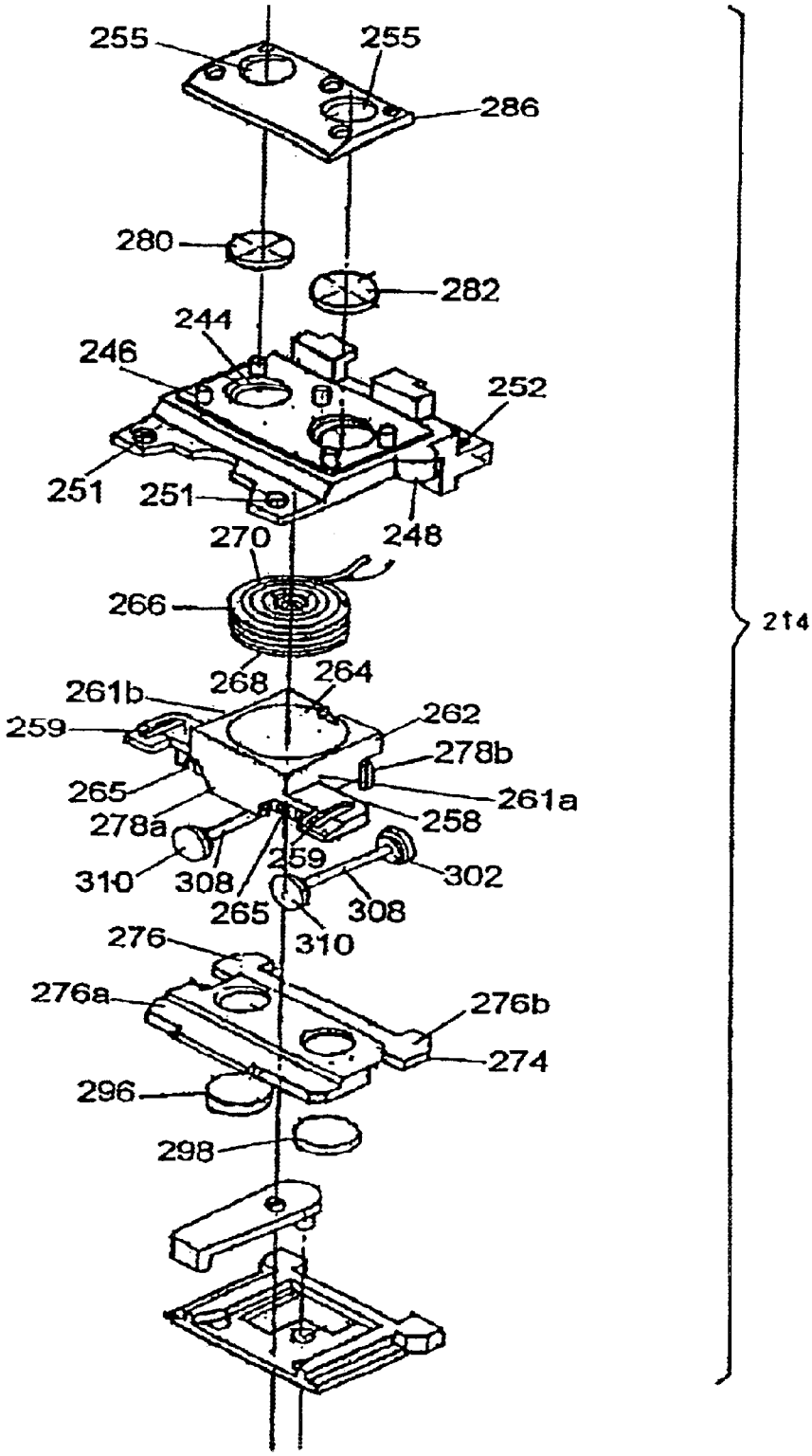
FIG. 12 illustrates an exploded view of an alternative embodiment for a steering module in accordance with the principles of the present invention.

FIGS. 12 and 13 illustrate another embodiment of a steering module for a steering mechanism in a toy vehicle. The module 214 includes a generally parallelpiped frame 262 having tabs 258 oppositely disposed on and extending outwardly from sides 261 of the frame 262. The tabs 258 include hole regions 259. The hole regions 259 are elongated, the function of which will be described below. The frame 262 is preferably made from plastic in order to reduce vehicle weight and costs. The frame 262 includes a generally hollow central area 264 that receives therein a coil 266. The coil 266 has a first end 268 and a second end 270 with an axis extending between the ends 268, 270 through the center of the coil similar to the axis A—A for coil 66 above. The coil 266 is sized to fit snugly within the hollow area 264 to thereby retain the coil 266 within the frame 262.

The bottom of the frame 262 includes ridges 278*a* and 278*b* oppositely disposed and extending downwardly from the frame 262. The bottom of the frame 262 includes grooves 265 disposed adjacent the ridges 278*a* and 278*b*. A groove 265 formed adjacent to ridge 278*a* is aligned (not shown) with a groove 265 formed adjacent to ridge 278*b*. The function of the grooves will be discussed below. A first bar 274, which is preferably made from plastic to reduce weight and costs, includes rails 276*a*, 276*b* cut on each side thereof that cooperate with ridges 278*a*, 278*b* formed on opposite side walls of the frame 262, whereby the first bar 274 is slidably engaged with the frame 262. Preferably as shown in FIGS. 12 and 13, the frame 262 with the coil 266 therein is moveable relative to the first bar 274 in a side to side or right to left manner. Mounted on the first bar 274, at spaced locations thereon, is a pair of magnetic disks 296, 298.

The hole regions 259 of the tabs 258 on the frame 262 interact with a wheel assembly, such as but not limited to the spindle 28 of wheel assembly 26*a*, 26*b* described above. The elongated structure of the holes 259 allows a spindle or other such retaining structure to move within the elongated region of the holes 259 as needed. When mounted in this fashion, movement of the frame 262 is transmitted to the wheel assembly thereby causing the wheels to be steered in a side to side or right to left manner.

A support member 246 is disposed on top of the frame 262 and attached by a pair of apertures 251 that align with posts such as posts 38 of the chassis 18 described above. The apertures 251 are fastened to the posts 38. In addition, bosses 252 correspond with bosses such as bosses 54 described above to also permit attachment of the rear end of the support member 246. Caps 248 are designed to fit over and provide rotatable support to the wheel assembly attached to the moveable frame 262. The support member 246 further includes through holes 244 for exposing magnets mounted thereon.

Further, like the first bar 274, a second bar 286 also is provided with a pair of magnetic disks 280, 282 mounted at spaced locations thereon. The second bar 286 is fixed onto the support member 246 as depicted in FIG. 13. The first bar 274, second bar 286 and magnetic disks 280, 282, 296, 298 are positioned such that the disk 280 is generally vertically aligned with the disk 296, and the disk 282 is generally vertically aligned with the disk 298. Although the magnets 280, 282, 296, 298 have been described as being discs, it is to be realized that other shapes could be used for the magnets as well. A similar configuration and relationship as described above for magnets 80, 82, 98, and 100 (FIG. 5) can be employed for magnets 280, 282, 296, and 298. In the preferred embodiment illustrated in FIGS. 12 and 13, the coil 266 is mounted to be moveable relative to the first bar 274, and the second bar 286 is fixed to the support member 246.

A biasing mechanism 302 is also provided in order to bias the coil 266 in the frame 262 to a central position once current flow through the coil 266 is stopped. As shown in FIGS. 12 and 13, the biasing mechanism 302 includes metal rods operatively connected with the first bar 274 and are received in the grooves 265 formed on the frame 262. The metal rods include a shaft portion 308 and rolling contact portions 310 enabling the metal rods to roll from side to side on the rails 276*a*, 276*b* of the first bar 274. Further, the metal rods extend across and overlap magnets 296, 298. Depending on the polarity of the current flowing through the coil 266, the coil 266 may move by rolling of the metal rods in a right to left manner towards the magnets it is attracted towards. The current flowing through the coil 266 enables the metal rods, coil, and frame to move, thereby overcoming the magnetic attraction between the metal rods and the magnets in their usual normal positions when a current is absent. When current flow through the coil 266 is stopped, the attraction of the metal rods to the magnets enables the metal rods to return to their original position thereby returning the coil 266 back to a central position after being moved either right or left by the current. Preferably, the metal rods are steel rods. Such a biasing mechanism 302 provides a durable structure, as the metal rods should not deform or weaken in resistance over time.

As discussed above in FIGS. 12 and 13, the coil and frame may be moveable relative to the first bar and second bar. An actuating bar, as in the embodiments described in FIGS. 1–11, is not employed in the structure illustrated in FIGS. 12 and 13. Tabs 258 are formed on sides 261 of the frame 262 and cooperate with a wheel assembly to transmit movement of the coil 266 and frame 262 to the wheel assembly for steering the wheels. For instance, the tabs 259 may connect with vertical pins 36 of the wheel assembly illustrated in FIGS. 1 and 4. The biasing mechanism 302 is employed to enable the frame 262 and coil 266 to slide from right to left across the rails 278*a*, 278*b* of the first bar 274. It will be appreciated that the biasing mechanism 302 may be employed for movement of the slide bars 74 and 86 described in previous embodiments, while maintaining the frame in a stationary position, with suitable modifications in a manner to accommodate incorporation of the metal rods of the biasing mechanism 302.

One set of magnets 296, 298 or 280, 282 may be used in the structure illustrated in FIGS. 12 and 13. In addition, the orientation of the steering module 214 may be modified to extend the central axis of the coil 266 generally forward and aft of the toy vehicle.

FIGS. 14 and 15 illustrate another embodiment of a wheel assembly 226 for a toy vehicle that includes a wheel 230 with a boss 225 extending outwardly from the side of the wheel 230. The boss 225 includes a hole 227 that cooperates with a through hole 231 of a spindle 228 and with a socket portion 233. The socket portion 233 includes a first end 221 in the form of a pin insertable through the through hole 231 of the spindle 228 and into the hole 227 of the boss 225 so as to fit snugly inside the hole 227. A second end 223 of the socket portion 233 is in the form of a socket connection. The features of the spindle 228 are similar in its design and function to the spindle 28 as described above.

The wheel assembly 226 further includes a bar member 237 that contains a gear portion 238 disposed between a first and second end of the bar member 237. The gear portion 238 cooperates with motorized drive mechanism of the toy vehicle (not shown) so as to be driven by the motorized drive mechanism. Socket members 239 are disposed at the first and second ends of the bar member 237, and cooperate with ball members 235. It will be appreciated that the socket members 239 and the bar member 237 may be integrally formed structures, rather than the separate structures illustrated in FIGS. 14 and 15. As illustrated on one side of the toy vehicle in FIGS. 14 and 15, it will be appreciated that both ends of the bar member will have identical structures of a socket member, ball member, socket portion, spindle portion and wheel connected thereto. The ball members 235 cooperate with the socket connection 223 of the socket portion 233 enabling the wheels 230 to pivot in connection with the bar member 237. Each ball member 235 has gaps or fittings enabling connection to the socket portion 233 and socket members 239. The structure of the wheel assembly illustrated in FIGS. 14 and 15 can be properly disposed onto a chassis, and enable simultaneous steering and driving of the wheel assembly.

The connection involving the socket portion 233, ball 235, and bar member 237 resembles a ball and socket joint relationship. This connection provides further stability in preventing the assembly from being broken. In addition, such a wheel assembly is simple to manufacture and assemble, and can be reduced to a very small size suitable for a small toy vehicle. The chassis may be modified in a manner to accommodate the socket portion, ball, and bar member structures as needed. As one example shown in FIG. 15, grooves 224 may be formed on the chassis to receive the bar member 237 and socket members 239 of the wheel assembly 226.

Figure 16:
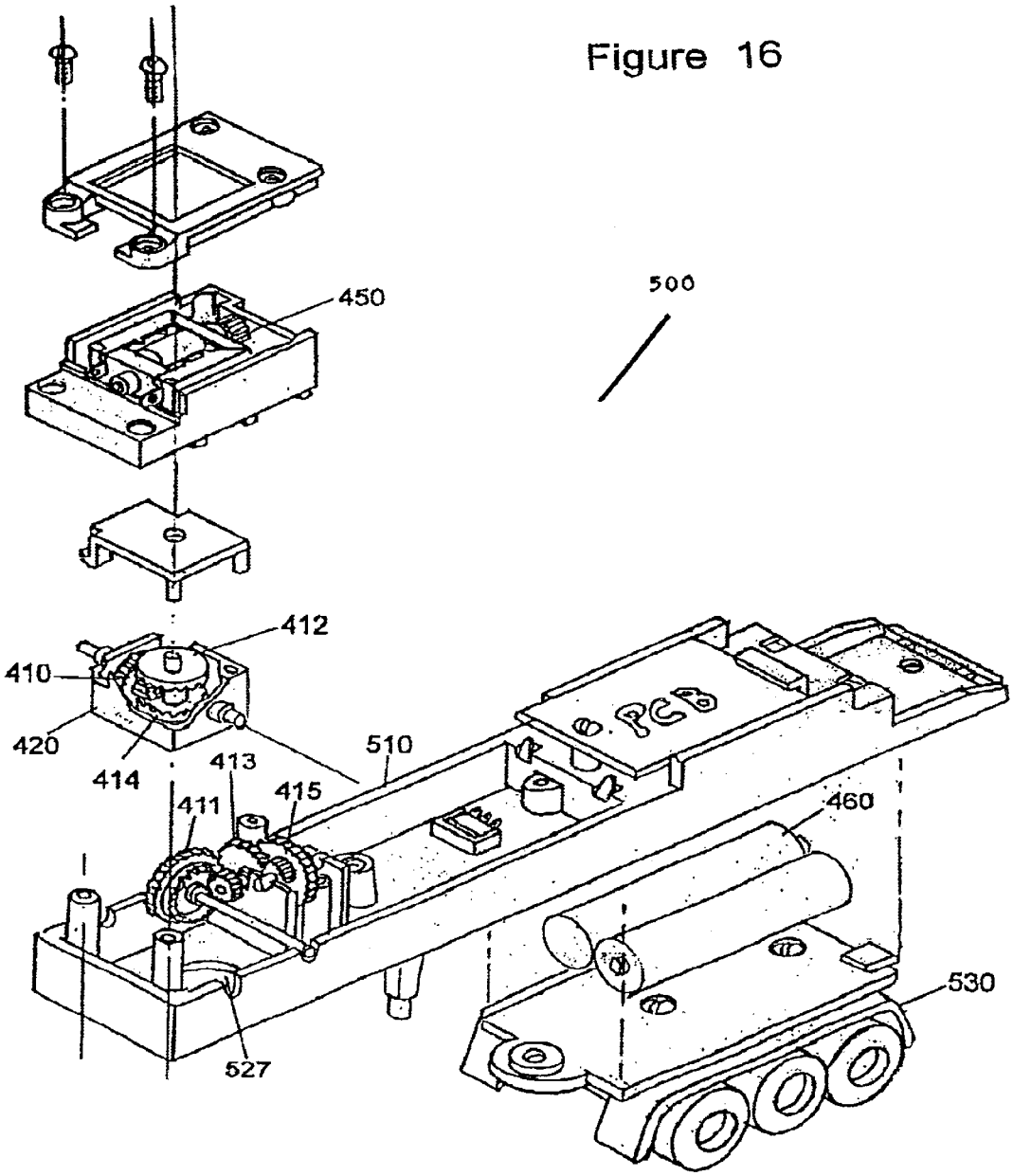
FIG. 16 illustrates a partially exploded view of a trailer portion of a toy vehicle in accordance with the principles of the present invention.
Figure 17:
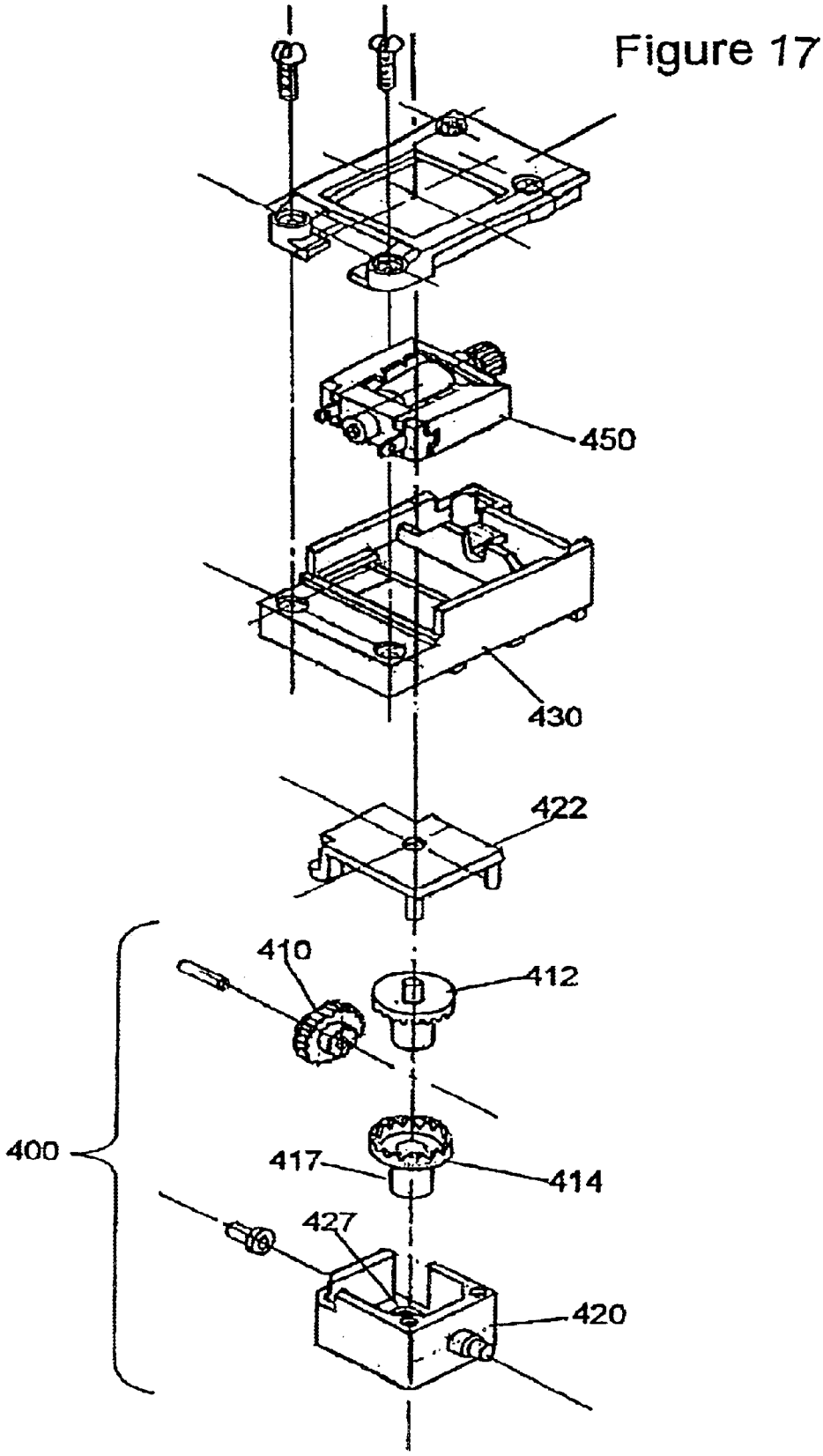
FIG. 17 illustrates an exploded view of a gear assembly of the trailer portion of FIG. 16.

In another embodiment of a toy vehicle, FIGS. 16 and 17 illustrate a trailer portion 500 that may be attached to a toy vehicle, including one of the previously described vehicles or to a different toy vehicle. The trailer portion 500 includes a bed 510 that may contain a power source 460 and a motor 450. The power source electrically connects with the motor to drive the motor. A trailer wheel assembly 530 is suitably attached to the bottom of the bed 510. The motor 450 controls a gear assembly 400 contained in a housing 420. A gear assembly 400 is disposed toward a front end of the trailer portion 500 so as to be connected with rear wheels of the toy vehicle. The gear assembly 400 includes a first gear 412 and a second gear 414 that simultaneously rotate in opposite directions when driven by a driving gear 410. The driving gear 410 cooperates with a series of gears 411, 413, and 415 so as to be operatively connected with the motor 450. The front end of the trailer portion includes an aperture 527, and the second gear 414 is provided with a boss 417 that extends through an aperture 427 at the bottom of the housing 420 and through the aperture 527 enabling connection with the toy vehicle. The boss 417 may be connected with the rear wheels of the toy vehicle via a suitable drive mechanism.

Figure 18:
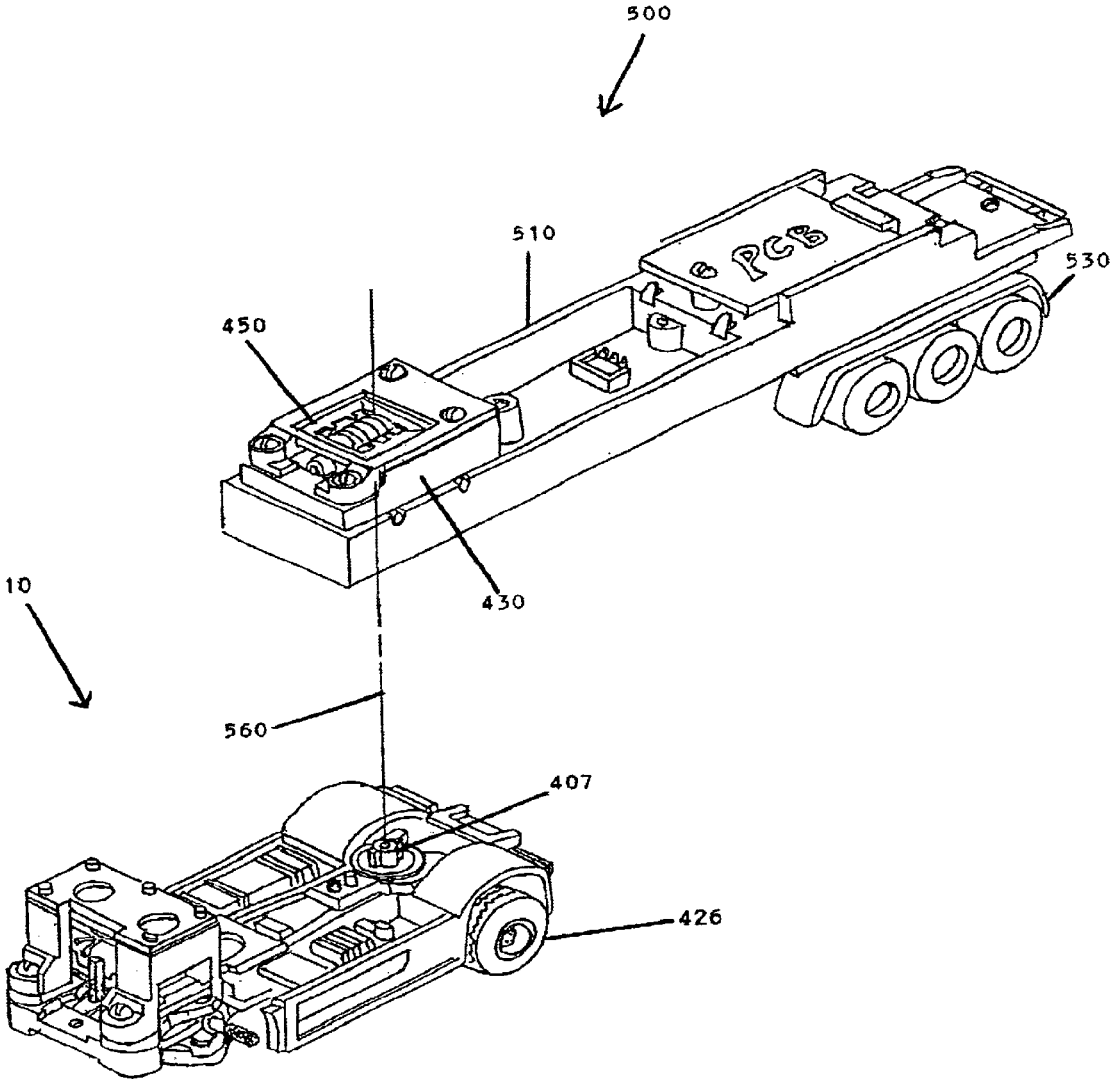
FIG. 18 illustrates the trailer portion of FIG. 16 in relation to a toy vehicle.

For example, as illustrated in FIG. 18, the boss 417 is operatively connected with a driving member 407. The driving member 407 is operatively connected with rear wheels 426 of a toy vehicle 101. The gear assembly 400 (not visible in FIG. 18) and motor 450 are retained in a retaining frame 430 at the front end of the bed 510. Line 560 indicates the connective relationship of the driving member 407 with the trailer portion 500. The driving member 407 engages with the boss 417 that extends through the aperture 427 at the bottom of the housing 420 and through the aperture 527 (shown in FIG. 17). The motor 450 drives gear 410 of the gear assembly 400. In turn, the driving gear 410, via gears 411, 412, and 415, drives the first gear 412 and the second gear 414 in opposite directions, where the boss 417 being operatively connected to the driving member 407 enables the toy vehicle 101 to be driven by the power source.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A trailer portion that is removably attachable to a toy vehicle having vehicle wheels for use in driving the vehicle wheels of the toy vehicle, the trailer portion comprising:

a bed containing a power source and a motor;

at least two trailer wheels connected to the bed that rollingly support the bed on the ground, wherein the trailer wheels are not operatively connected to a drive mechanism so that the trailer wheels are not driven;

a gear assembly residing in a housing mounted on the bed and including a first gear;

a second gear;

a boss connected to the second gear and configured for connection to and driving engagement with a driving member of the toy vehicle that is in driving engagement with the vehicle wheels of the toy vehicle through a drive mechanism; and a driving gear that drives both the first and second gears;

and the gear assembly being operatively connected with the motor.

2. The trailer portion of claim 1, wherein the boss is rotatable about a vertical axis and the first and second gear are rotatable in opposite directions when driven by the driving gear.

3. The trailer portion of claim 1, further comprising a trailer wheel assembly attached to the bed, and wherein the trailer wheels are part of the trailer wheel assembly.

* * * * *